US006896935B2

(12) United States Patent
Kimura et al.

(10) Patent No.: US 6,896,935 B2
(45) Date of Patent: May 24, 2005

(54) ELECTROSTATIC POWDER COATING METHOD FOR THE INNER PERIPHERY OF A TUBE HAVING A SHOULDER

(75) Inventors: Taizo Kimura, Osaka (JP); Naoki Fujisawa, Osaka (JP)

(73) Assignee: Taisei Kako Co., Ltd., Osaka (JP)

( * ) Notice: Subject to any disclaimer, the term of this patent is extended or adjusted under 35 U.S.C. 154(b) by 0 days.

(21) Appl. No.: 10/358,554

(22) Filed: Feb. 5, 2003

(65) Prior Publication Data

US 2003/0148028 A1 Aug. 7, 2003

(30) Foreign Application Priority Data

Feb. 7, 2002 (JP) ..... 2002-030495

(51) Int. Cl.[7] ..... B05D 1/04

(52) U.S. Cl. ..... 427/476; 427/475; 427/478; 427/486

(58) Field of Search ..... 427/475, 476, 427/478–480, 485, 486, 482, 232–236, 238–239, 421, 425, 426; 118/689, 690, 692, 622

(56) References Cited

U.S. PATENT DOCUMENTS 3,995,586 A 12/1976 Crose et al.
4,987,001 A * 1/1991 Knobbe et al.
5,138,972 A 8/1992 Glanzmann
5,362,327 A 11/1994 Sessa et al.
5,739,429 A 4/1998 Schmitkons et al.
6,129,946 A * 10/2000 Adams

* cited by examiner

*Primary Examiner*—Fred J. Parker
(74) *Attorney, Agent, or Firm*—Wood, Phillips, Katz, Clark & Mortimer

(57) ABSTRACT

A method of forming a coating on an inner periphery of a tube with a cylindrical barrel, a mouth on one axial end of the barrel, and a shoulder located between the barrel and the mouth. The method involves holding the tube, and subsequently jetting powder into the tube from a spray gun, through a bottom side opening on the other axial end of said barrel. A first passage guides to the spray gun a first air stream together with the powder. A second passage feeds to the spray gun a second air stream with the powder. A third passage suction collects surplus powder through the tube mouth. A fourth passage suction collects surplus powder through the bottom side opening of the tube. At least one of the passages is subject to a feedback control such that flow rate and/or internal pressure therein are maintained at target levels.

3 Claims, 4 Drawing Sheets

ELECTROSTATIC POWDER COATING METHOD FOR THE INNER PERIPHERY OF A TUBE HAVING A SHOULDER

FIELD OF THE INVENTION

The present invention relates to a method of properly forming in an electrostatic manner a resin membrane or the like on the inner periphery of a metallic tube such as an aluminum tube or an aerosol container.

BACKGROUND OF THE INVENTION

Aluminum tubes have been and are used as the containers for various contents that are in a paste state. Each aluminum tube has a cylindrical barrel and a mouth continuing from one of opposite ends of this barrel through a shoulder. The other end of each tube is a skirt that will be kept open while the tube whose mouth has been closed with a cap is subsequently charged with the content. Finally, the rim of such a skirt will tightly be folded back to seal the bottom of this tube so that the content is isolated from ambient air. The content will thus be protected from any adverse effect of air or humidity so as to be free from degeneration or deterioration during a long-term storage. Generally, the upper portion of cylindrical barrel of each tube gradually decreases its diameter towards the mouth, due to presence of the substantially frustoconical shoulder. In other words, diameter of the mouth is considerably smaller than that of said barrel.

Materials of such tubes are usually aluminum, tin, lead or alloys thereof. After having depressed the barrel of each metallic tube to extrude its content through the mouth, it will maintain its depressed configuration, lest any amount of ambient air causing degeneration or deterioration of the content should intrude into it. Therefore, such metallic tubes easy to manufacture and processing and convenient to carry are widely used as the containers for pastes of various pharmaceuticals, hairdressings, hair dyes, cosmetics, foods or adhesives.

It is to be noted that some contents will cause corrosion of metallic tubes filled with them. In this case, an anti-corrosion resin layer or the like has been formed on the inner periphery of each tube by the electrostatic powder coating system.

Practically, a spray gun will be placed in the tube through its open skirt, and a fine resin powder is blown into the tube together with air so as to stick to the inner periphery. Thereafter, the tube will be heated to melt the layer of resin powder and then cooled down to form a solid resin membrane on said periphery.

However in such a powder coating method, the inner periphery of tube shoulder is prone to receive a very excessive amount of the resin powder, failing to spread it uniformly all over the inner peripheries of mouth, shoulder and barrel of each tube. As a result, an excessively thick resin membrane on the inner periphery of shoulder has often hindered smooth extrusion of content. In detail, such a shoulder will resist its depression, making it difficult to squeeze a residual amount of the content stagnant around the shoulder, out of such a tube.

In addition, such a molten and thickened resin membrane formed on the inner periphery of shoulder will show a remarkable secondary shrinkage when it solidifies, probably causing exfoliation of the other lining portion sticking to the inner periphery of mouth.

In some cases, a certain region of inner periphery of the skirt that is to be folded back and sealed should be masked from the resin powder. It has however been difficult to selectively mask only such a skirt region, because the resin powder has been blown in through said skirt.

The prior art powder coating method has therefore been carried out in such a manner that ejection pressure and flow rate of the resin powder would be regulated taking a view of the coating being formed. If a moderate and proper amount of resin powder is applied to the shoulder, then the barrel would be provided with an insufficient quantity of said powder, probably producing a number of pinholes in such a thinned resin coating. On the contrary, if a moderate and proper amount of resin powder is applied to the barrel, then the shoulder would be provided with a very excessive quantity of said powder. Similarly to such a dilemma, a proper and uniform application of resin powder to the barrel has often failed to provide a skirt opening reliably coated with a reduced amount of said resin.

The prior art powder coating apparatuses have undesirably produced container tubes with inner peripheries coated with resin layers of varied thickness, thereby lowering yield of satisfactory products coming up to the standard, even if ejection pressure and flow rate would have been controlled. Flow passages and spray gun included in each of those prior art apparatuses have been likely to be clogged with resin powder, and therefore improvement of them has been required.

SUMMARY OF THE INVENTION

The present invention was made in view of these inconveniences and problems inherent in the prior art. Thus, an object of the present invention is to provide a powder coating apparatus designed such that the inner periphery of a tube or the like having a shoulder can be coated with a film of a reliably even thickness.

In order to achieve this object, the present inventors have employed a technological feature as summarized below.

The powder coating apparatus provided herein to form a coating on the inner periphery of a tube having a shoulder may comprise a holder for holding the tube further having a cylindrical barrel and a mouth provided in a connected row arrangement on one axial end of the barrel through the shoulder, a gun for jetting powder into the tube through a bottom side opening disposed on the other axial end of said barrel of the tube held in the holder, a first passage for guiding a first air stream to the gun together with the powder to be jetted, a second passage for feeding to the spray gun a second air stream that is being supplied with the powder, a third passage for suction collecting surplus powder through the mouth of the tube, a fourth passage for suction collecting surplus powder through the bottom side opening of the tube, and at least one control unit related to at least one of the first to fourth passages. The at least one control unit may be capable of doing feedback control such that flow rate and/or internal pressure of the passage related to said unit are maintained at target levels.

The four passages may directly be connected to the spray gun and/or to the holder. Alternatively, those passages may be composed of a few or several piping sections for flowing therethrough each compressed air stream. The feedback control may be based on the data per se, or possibly on the basis of certain relationship between the data, of flow rate or internal pressure detected at predetermined positions of each passage. However, such a control may not take into account any overall condition covering the whole length of each passage.

The second air stream fed through the second passage into the spray gun may serve to disperse or stir therein the powder delivered thereto through the first passage. Alternatively, the second air stream may simply be mixed with said powder (by the air-mixing process). Practical manner of utilizing the second air stream may be changed properly depending on the type and structure of the spray gun, on the material and dimension of the tube in which powder coating is to be formed, and/or on the thickness and material of said coating. In any case, preliminary tests had better be conducted to collect necessary data for optimizing the feedback control to ensure excellent coatings of a higher reproducibility Feedback control may be done for objective devices regulating the flow rate or internal pressure at predetermined points of the passage. The objective devices may be regulators such as proportional control valves, throttle valves, flow rate adjusting valves or the like electromagnetic valves. Each regulator may be disposed at an intermediate point of the passage of which the control unit is concerned, although a few or several regulators can be disposed at more than one point. Desirably, a pressure sensor and/or a flow rate sensor are disposed intermediately between the spray gun or holder and each regulator so that the latter can be feedback controlled based on output signals from such sensors.

It also is desirable that the piping of each passage is designed to diminish the degree of flow instability such as turbulent flows on one hand, and air pressure fed to each passage is made as stable as possible. For these purposes, the inner diameter of each passage will be adjusted, with its flow resistance against the air stream being minimized at the same time by avoiding a sharp or sudden change in diameter and eliminating lugs, sharp shoulders or the like stepwise irregularities at a joint between the sections of said piping. If the inner diameter has to be changed at a point, then the piping section should be gradually increased or decreased in diameter. At another point of passage where it is to be curved, its radius of curvature may be maximized. Capacity of an air tank or accumulator for feeding a compressed air to each passage may be made as large as possible to avoid pressure drop in the air streams being blown in or exhausted out.

By virtue of such a flow system, abrupt start of air flow taking place whenever jetting, ejection or exhaustion of the air-matrix suspension of powder is initiated will scarcely bring about any sharp change in internal pressure of each passage. The air feed pressure stabilized as above will be effective to minimize the drop of internal pressure during the ejection of said powder suspension.

The apparatus constructed to have the optimized piping and assure a stable air feed pressure as summarized above will be subjected to a series of test runs to collect necessary data, which are then used to preset the control unit to perform an optimum feedback control. Any transient fluctuation will not take place in each passage with respect to its internal pressure or with respect to the flow rate of the stream flowing through the passage. Throughout every cycle of ejection and every cycle of exhaustion of the air stream, the internal pressure as well as flow rate is thus kept highly stable. Resin coatings formed on the tube inner peripheries will be of a diminished variation in thickness and free from defects (viz., pinholes), and a rim zone of the skirt of each tube can now be masked in a reliable manner. Performance of this apparatus is of such a satisfactory degree of reproducibility that a series of coating tests will not show any noticeable variation in the resin coatings and the masked regions.

In short, such a proper piping and stable air pressure will almost exclude transient fluctuation of internal pressure and flow rate, with the aid of feedback control. The internal pressure during each cycle of ejection is thus highly stabilized to form a very uniform resin coating on the inner periphery of each tube.

The feedback control system may be designed herein to control either of or both the internal pressure in and the flow rate through each passage.

Most desirably, each of the control units may be provided respectively for the four passages. For example, each of the flow passages may be controlled by one control unit allocated thereto in order to maintain the internal pressure and/or flow rate at respective target levels. By such a control system, uniform coating will be formed throughout the inner periphery of tubes, with its skirt being surely masked.

The control unit may comprise a regulator that is actuated to regulate the internal pressure in and/or flow rate through each passage, a sensor for detecting the internal pressure and/or flow rate, and a controller for feedback controlling on the basis of detective signals of the sensor.

The regulator of a proper type such as adapted to the variable opening area control for each passage may for example be a flow regulating valve or a pressure regulating valve. The flow regulating valve may be a throttle valve such as a variable orifice valve or a choke valve, or alternatively be a flow adjusting valve, a distributing valve or a converging valve. The pressure regulating valve may be a relief valve, a safety valve, a counter-balance valve, an unloader valve or the like. Although the regulator may be actuated by a fluid pressure such as an oil-hydraulic pressure or a pneumatic pressure, it is more desirable to employ an electromagnetic valve such as a proportional control valve or servo valve.

The controller will compare respective preset target values with output signals representing actual internal pressure of and/or flow rate through each passage, with these signals being delivered from the sensors. Upon comparison of the actual signals with the target values, the controller will produce feedback signals that are applied to the regulator. Thus, the regulator supplied with such feedback signals will function to control the internal pressure and/or flow rate at their target values, for example by adjusting the passage opening area or the like parameter.

In this mode of carrying out the present invention, the optimized piping and stabilized air source pressure will preliminarily and roughly reduce the fluctuation in internal pressure of each passage, and the feedback control described above will more thoroughly eliminate said fluctuation.

The apparatus of this invention may further comprise a control valve for opening or closing the passage related to the control unit. For example, the control valve may be added to the flow passage control unit so that the output signals from sensors may used to feedback control the timing at which said control valve is closed or opened. Even if any sharp change in the internal pressure or flow rate would tend to deviate from control by the regulator, a period of time in which the air is blown into the passage can be adjusted to compensate such a sharp change so as to ensure a uniform and reliable powder coating.

The apparatus of this invention may further comprise a control valve for opening or closing the first passage disposed in the first passage, a sensor for detecting the internal pressure and/or flow rate of the first passage disposed in the first passage, and a determination unit to determine a timing which should close the control valve based on signals that the sensor has been detecting after the control valve had been opened. In this connection, a flow rate sensor may for example be used to integrate the flow volume of air that will have passed through the first passage after opening the control valve. In detail, such a determination unit will function to successively produce a series of integrated signals one after another at every instant after having opened the control valve. When a current integrated signal is judged to have reached a target value, the determination unit will output a command signal to close the control valve. The determination unit and the control unit may be composed in a common sequencer, a common computer or the like control apparatus.

The total volume of air that will have been fed to the spray gun through the first passage in this case does not vary from cycle to cycle of ejecting the powder. Even if the flow rate through this passage changes accidentally and temporarily during any of said cycles, such a constant total volume of the air carrying the powder will avoid variation among the tubes with respect to the state of powder sticking to their inner peripheries.

A pressure sensor may substitute for the flow rate sensor in order to cooperate with the determination unit. In this case, data of instant pressure during the coating of each tube will be integrated for the first passage so as to give a total pressure. This total pressure will be kept at one and the same target value among the cycles of coating the tube, whereby any temporary fluctuation in the internal pressure is compensated not to result in any change in the sum of fed powder.

The control valve, the sensor and the determination unit may not necessarily be provided only for the first passage. It is possible or rather desirable to incorporate them also for the second to fourth passages.

In one case, the apparatus of this invention may further comprise a first control valve for opening or closing the first passage, a second control valve for opening or closing the second passage, a third control valve for opening or closing the third passage, and a fourth control valve for opening or closing the fourth passage. Consequently, respective timing data for actuation of those control valves may be collected previously for enabling such independent controls thereof so that the resin coatings each of an even thickness and each precisely masked at the tube skirt rims can reliably be produced in a stable manner.

Each passage may be designed such that the internal pressure and/or flow rate thereof are fixed generally even if the feedback control is switched off during jetting the powder from the gun with the control valve having been opened.

For this purpose, here may be employed such an air accumulator or tank as the source for supply or collect compressed air as remaining almost unchanged and stabilized in pressure during each cycle of ejection or exhaustion of the powder. In detail, the tank may be of a sufficient compressing capacity or a sufficient static volume. Alternatively, one and the same central air tank may be used for all of the flow passages, if a supplementary tank is disposed for each passage so as to temporarily store in it a batch of compressed air fed from the central tank. Any supplementary tank of a smaller capacity as compared with the central tank may suffice, provided that completion of each coating cycle is ensured.

Also for stabilizing the internal pressure of each passage, the flow resistance thereof may be minimized, with its cross-sectional area being designed uniform from its beginning to its end, and diminishing the number of its curved or bent portions. Such structural features as discussed above will make it possible to stabilize the internal pressure or flow rate at least during each cycle of ejecting the powder out of spray gun, even with the feedback switched off.

The third and fourth passages may be designed similarly to the first and second passages, if it is possible to stabilize the internal pressure or flow rate during each cycle of exhausting a surplus of the aerosol away from the spray gun or tube.

A method may be provided herein to form a coating on the inner periphery of a tube that has a cylindrical barrel, a mouth provided in a connected row arrangement on one axial end of the barrel, and a shoulder located between the barrel and the mouth. This method may comprise the step of preliminarily holding the tube in a holder, and subsequently jetting powder into the tube from a spray gun, through a bottom side opening disposed on the other axial end of said barrel of the tube held in the holder. In the present method, a first passage is used to guide to the spray gun a first air stream together with the powder to be jetted, a second passage is used to feed to the spray gun a second air stream that is being supplied with the powder, a third passage is used to suction collect surplus powder through the mouth of the tube, and a fourth passage is used to suction collect surplus powder through the bottom side opening of the tube. And, said at least one of the first to fourth passages is subject to such a feedback control that flow rate and/or internal pressure of the at least one passage are maintained at target levels.

Furthermore, the feedback control may be carried out for each of the first to fourth passages. In any case, ratio of the average thickness of a coating formed on the inner periphery of the shoulder to that of another coating on the inner periphery of the barrel is made less than 10 (ten), preferably less than 5 (five), and more preferably less than 1.5 (one point five).

THE PREFERRED EMBODIMENTS

Figure 1:
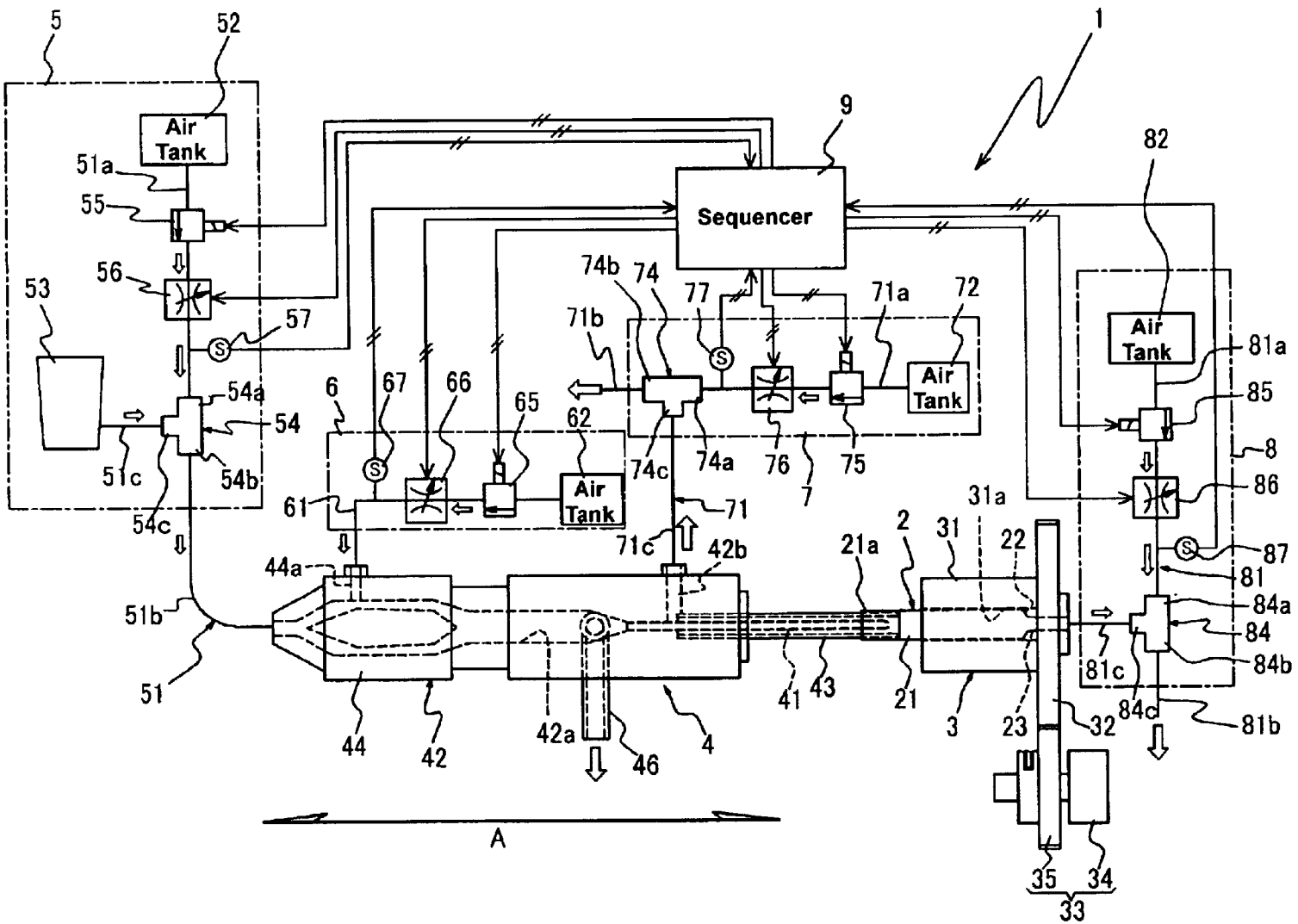
FIG. 1 is an overall scheme of a powder coating apparatus provided in a first embodiment of the present invention so as to use a resin powder to form a resin coating on the inner periphery of a tube.

Now some embodiments of the present invention will be described referring to the drawings.

An electrostatic powder coating apparatus 1 shown in FIG. 1 comprises a tube holder 3, a spray gun 4, a powder conveying unit 5, a stirring-air feeding unit 6, a powder collecting unit 7 for bottom side of the tube, a powder collecting unit 8 for mouth side of the tube, and a sequencer 9 for controlling the apparatus.

The tube holder 3 will retain an aluminum tube 2 (viz, container) during the powder coating process. The spray gun 4 for jetting the powder 'C' into each tube 2 is movable towards and away from the holder 3, longitudinally thereof as indicated at the arrow 'A'. The powder conveying unit 5 will propel the powder together with a gas stream (e.g., air stream) towards the spray gun 4, through a powder feeding passage (viz., first passage) 51. On the other hand, the stirring air-feeding unit 6 propels a further gas stream (e.g., air stream) also towards the spray gun 4, but through an air feeding passage (viz., second passage) 61. The powder collecting unit 7 will suck an aerosol fraction of the powder so as to suck and collect a surplus thereof away from the skirt (viz., a bottom side opening disposed on the other axial end of the barrel) of tube 2, through a suction passage 71 for the tube skirt. Similarly, the further powder collecting unit 8 sucks another aerosol fraction of the powder so as to extract and collect another surplus thereof away from the mouth of tube 2, through a powder collecting passage 81 from the tube mouth.

Figure 2:
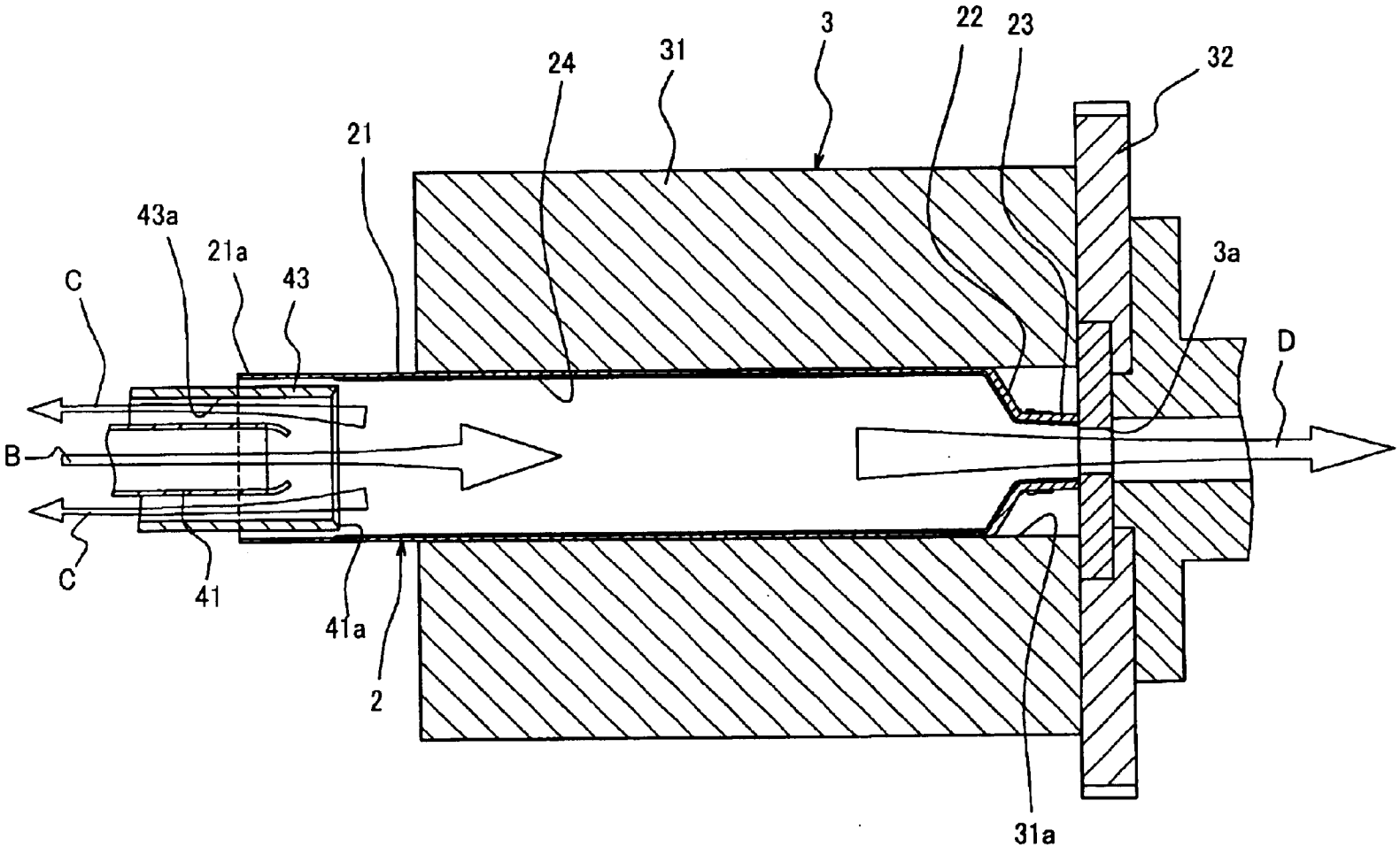
FIG. 2 is an enlarged cross section of a tube that is held in a holder, wherein the powder is being blown into the tube, with a surplus of the powder being extracted from said tube.

During each coating cycle using this apparatus 1, a jet nozzle 41 of the spray gun 4 will jet therefrom a continuous amount of the electrostatically charged resin powder into the tube 2, as indicated by the arrow 'B' in FIG. 2. At the same time, air fractions carrying the surpluses of said powder are sucked from the tube's internal regions adjacent to its skirt and its mouth, as respectively indicated by the arrows 'C' and 'D', so as to collect those surpluses. An anti-corrosion coating 24 thus formed on the inner peripheries of barrel 21, shoulder 22 and mouth 23 will generally be of a uniform thickness all over these peripheries. The inner periphery of tube skirt 21*a* will be masked not be covered with a coating 24 thus formed.

The electrostatic coating powder for use in this apparatus 1 may be the fine powder of any proper thermosetting resin such as an epoxy resin and a melamine resin, or any proper thermoplastic resin such as a polyethylene resin, a polypropylene resin and a polyester resin. The resin selected herein must not only be inactive to the content of tube 2, but also be adhesive to the material of the tube itself.

In detail, one of opposite ends of the cylindrical barrel 21 of tube 2 continues to the frustoconical shoulder 22, which in turn continues to mouth 23 as seen in FIG. 2. The mouth 23 has an inner diameter that is smaller than, and exemplarily about a half of, that of barrel 21.

The tube holder 3 serving to hold the tube 2 in alignment with the axis of the jet nozzle 41 of spray gun 4 is supported on a proper frame not shown so as to rotate about its own axis. Both the holder 3 and frame are made of a conductive material such as a metal, for example iron, so that they are earthed to the ground to enable the electrostatic coating of tube 2.

In the illustrated embodiment, the holder 3 comprises a cylindrical body 31 having opposite ends, and a geared wheel 32 is secured to one of these ends. A tube holding cylindrical cavity 31*a* defined through the holder body 31 has an inner diameter generally equal to the outer diameter of the tube barrel 21. The tube 2 will take a horizontal position when guided by its mouth 23 into the cylindrical holder body 31, so that the outer periphery of said tube comes into a close contact with the inner periphery of said cavity 31*a*. The further suction passage 81 for the tube mouth is connected to the cavity opening surrounding the open end of tube mouth, whereby a surplus of the powder suspended and floating in the air within the tube will be sucked out for suction via the passage 81.

A drive unit 33 causing the holder 3 to spin is composed of a motor 34 and a drive gear 35 fixedly mounted on an output shaft of said motor. The drive gear 35 always in mesh with the gear 32 of holder 3 is driven to rotate by actuating the motor 34, which is controlled preferably by a sequencer 9 serving as a proper controller therefor. Also preferably, the motor 34 will operate only while the powder is blown from the spray gun 4 into the tube 2 that is then spinning in and together with the holder 3. The powder will thus be applied evenly to the entire inner periphery of tube 2, and the tube 2 can easily be replaced with a new one while the motor stands still.

The spray gun 4 comprises a generally cylindrical body 42, the jet nozzle 41 disposed on one of opposite ends of said body, and a powder collecting cylinder 43 surrounding the nozzle. An axial bore 42*a* penetrating the gun body 42 has opposite ends, and one of them (viz., down-stream end) is connected to the jet nozzle 41, with the other (viz., upstream) end being connected to a terminal of the powder feeding passage 51.

Defined in the gun body 42 and intermediate between opposite ends of its axial bore 42*a* is a stirring chamber 44 having a sideways air inlet 44*a*. This inlet 44*a* is formed radially of said chamber and connected to the terminal of air feeding passage 61. The stirring air charged inwards through the passage 61and air inlet 44*a* will be jetted into the axial bore 42*a* forming the stirring chamber 44. Thus, powder particles that are dashing towards the downstream end of said bore 42*a* are tumbled and disintegrated. In an alternative example, the stirring chamber 44 and the gun body 42 may be formed as discrete sections communicating with each other through an extra piping.

The jet nozzle 41 is an elongate and thin metal tube having an end opening 41*a*. A corona gun (of the type charged with a high-voltage current) not shown but likewise having a jet nozzle may substitute for the spray gun described above. A high-voltage source circuit cooperates with the corona gun to give an electrostatic charge to powder particles flowing through the nozzle. In place of such a corona gun, a tribo gun (of the tribo-electrification type) may be employed, which will cause friction between said flowing particles to be electrostatically charged.

The powder collecting cylinder 43 attached to the gun body 42 extends over the full length of nozzle 41. An annular clearance is provided between the outer periphery of nozzle 41 and the inner periphery of said cylinder 43, so as to define a suction passage 43*a*. This passage 43*a* will serve as a canal for sucking and collecting powder particles that are floating within the tube 2, out of proximity of the nozzle end opening 41*a*, and in a direction opposite to the normal flow direction of said particles. A sideways outlet 42*b* branched off the downstream end of suction passage 43*a* is enclosed in the gun body 42 so as to open outwards and near the basal end of said suction cylinder 43, in order to be connected to the suction passage 71.

The spray gun 4 rides on rails (not shown), and a proper drive mechanism forces it to reciprocate longitudinally thereof. When the powder is ejected from the tip end of nozzle 41, the spray gun 4 will be moved such a distance that said tip end is located in the tube skirt 21*a*. The spray gun will however be retracted away from the holder 3, after the inner periphery of current tube 2 has been powder-coated so as to be replaced with a new one. In order to enable such reversible displacement of the spray gun 4, the lengths of piping 51, 61 and 71 adjoined therewith have to be flexible tubes such as formed of proper plastics bellows or rubber tubes.

A drain pipe 46 communicating with the axial bore 42*a* of gun body 44 leads to suction tank (not shown) for the purpose of braking the internal pressure of the spray gun 4.

The powder conveying unit 5 may comprise the powder feeding passage 51, a compressed air tank 52, a hopper 53, a T-shaped ejector pump 54, an electromagnetic switching (interrupting) valve 55, a regulator 56 and an air pressure sensor 57. The interior of air tank 52 is controlled to be at a given level of internal pressure, with the hopper 53 being for storage of the powder to be ready for use. The ejector pump 54 is composed of an upstream portion 54*a*, a downstream portion 54*b* and a branch pipe 54*c*. Both the electromagnetic valve 55 and regulator 56 are disposed in a first section 51*a* of the passage 51 and between the tank 52 and ejector pump 54, with the sensor 57 being located downstream of the regulator 56.

The powder feeding passage 51 consists of the first section 51*a*, a second section 51*b* and a third section 51*c*. The first section 51*a* is connected to the air tank 52 and to the upstream portion 54*a* of ejector pump 54, in communication with them. The second section 5*b* of passage 51 is connected to the hopper 53 and the branch pipe 54*c* of ejector pump 54, also in communication with them. The third section 51*c*, which may be formed of a flexible length of a proper tube, is connected to the downstream portion 54*b* and an upstream end of the spray gun passage 42*c*, likewise in communication with them. The sensor 57 may alternatively be disposed in any intermediate region of the second section 51*b* of passage 51, thus down-stream of the ejector pump 54, or disposed upstream of the regulator 56.

Incorporated in the ejector pump 54 and between its upstream and downstream portions 54*a* and 54*b* aligned with each other is a venturi that continues to the branch pipe 54*c*. An air stream maintained at a constant pres-sure and fed through the first section 51*a* of passage 51 into the upstream portion 54*a* of ejector pump 54 does flow through this venturi into the downstream portion 54*b* of this pump, so as to produce a negative pressure inside the venturi. As a result, an amount of the powder stored in the hopper 53 will be sucked into the venturi, through the third section 51*c* of passage 51 and the branch pipe 54*c* of ejector pump 54. The amount of said powder passes through the venturi and flows together with the air into the second section 51*b* of passage 51, via the downstream portion 54*b* of the ejector pump 54.

The air tank 52 is provided with a regulator (not shown) to keep the internal pressure of this tank at a given constant target level. An auxiliary tank may be added to this tank 52, adjacent thereto and downstream thereof, in order to diminish fluctuation of air pressure during every cycle of ejecting the powder.

The electromagnetic control valve 55 will act to open or close the first section 51*a* of the powder feeding passage 51, being commanded by a control signal from the sequencer 9. The regulator 56 that may be a variable orifice valve is however adapted to proportionally control the internal pressure or flow rate of air within the said first section 51*a*. This is because it can increase or decrease its area of opening, following another series of command signals from said sequencer 9. The pressure sensor 57 for detecting the internal pressure of the air stream flowing downstream of regulator 56 does generate and transmit to the sequencer 9 data signals for producing said command signals. A flow rate sensor may substitute for such a pressure sensor.

A logic controller or logic integrated circuit may be used as the sequencer 9 functioning with control parameters that can be variably set at any varied and desired values. As noted above, this sequencer serves also for the stirring air-feeding unit 6, the powder collecting unit 7 for the skirt of each tube, the further powder collecting unit 8 for the mouth of each tube.

The sequencer 9 may function for example in the following manner. Namely, initial command signals from this sequencer will open the control valve 55 so that the compressed air flows from the tank 52 and through the regulator 56 into the ejector pump 54. The pressure sensor 57 will then detect actual internal pressure of the flowing compressed air stream, generating data signals. The sequencer 9 receiving these data signals will successively compare each of them with the preset target value so as to produce and transmit to the regulator 56 a feedback signal. Consequently, this regulator conducts a real time control to increase or decrease its opening area so that the actual pressure coincides with the target level. After lapse of predetermined period of time, the sequencer 9 will close the control valve 55. In this way, these regulator 56 and sequencer execute a feedback control maintain the actual flow rate and internal pressure at the respective target values in the powder feeding passage 51 and downstream of the ejector pump 54.

It will now be apparent that the powder feeding passage 51 is formed as a continuous flow line that starts from the air tank 52 and leads to the spray gun 4, through such an on-off valve 55, the regulator 56 and the ejector pump 54. An amount of the powder sucked from the hopper 53 at the intermediate region of such a continuous line will be sent together said air stream towards the spray gun 4.

It may be possible that the sequencer 9 cooperates with the control valve 55 such that the total amount of powder ejected during every cycle will be adjusted. With the valve 55 being opened by the command signal from sequencer 9, the compressed air starts to flow out of the tank 52 towards the downstream side of the continuous flow line. The pressure sensor 57 commences to produce a series of data signals representing the actual and possibly varying internal pressure in said line. Consequently, the sequencer 9 integrates these successive data signals from said sensor 57 so as to produce a series of integrated sums, until the last one of them becomes equal to the preset reference value. Upon coincidence of the integrated sum with this reference value, the sequencer 9 closes the control valve 55 to cease the feeding of compressed air to the spray gun.

By virtue of such a feedback control, if the internal pressure would suddenly rise tending to increase the feed rate of powder, an effective period of ejection will be shortened lest the actual total amount of powder should increase. On the contrary, if the internal pressure would suddenly descend tending to decrease the feed rate of powder, the effective period of ejection will be lengthened lest the actual total amount of powder should decrease. Thus, even if the regulator 56 could not follow any sharp change in the internal pressure, the total quantity of powder blown into the tube 2 will not vary to any noticeable extent that would adversely affect the uniform coating of the masked inner periphery of tube. In order to enable such a mode of control just described above, a determination unit may be composed within the sequencer 9. This unit will determine the timing at which said valve 55 should be closed based on the sum of data signals that would have been transmitted from sensor 57 after opening the valve 55. Alternatively, such a determination unit may be formed as a discrete controller different from the sequencer 9.

The stirring air-feeding unit 6 may comprise the air feed passage 61 for directing the stirring air to the stirring chamber 44 in spray gun, a compressed air tank 62, an electromagnetic switching (interrupting) valve 65, a regulator 66 and an air pressure sensor 67. The interior of air tank 52 is controlled to be at a given level of internal pressure. Both the electro-magnetic valve 65 and regulator 66 are disposed at an intermediate region of the passage 61. The sensor 67 is located downstream of the regulator 66, although it may be disposed upstream of this regulator.

The air tank 62 is provided with a regulator (not shown) to keep the internal pressure of this tank at a given constant target level. An auxiliary tank may be added to this tank 62, adjacent thereto and downstream thereof, in order to diminish fluctuation of air pressure during every cycle of ejecting the powder.

The electromagnetic control valve 65 will act to open or close the air feed passage 61, being commanded by a control signal from sequencer 9. The regulator 66 that may be a variable orifice valve is however adapted to proportionally control the internal pressure or flow rate of air within the said first section 51*a*. This is because it can increase or decrease its area of opening, following another series of command signals from said sequencer 9. The pressure sensor 67 for detecting the internal pressure of the air stream flowing downstream of regulator 66 does generate and transmit to the sequencer 9 data signals for producing said command signals. A flow rate sensor may substitute for such a pressure sensor.

Similarly to the case of powder conveying unit 5, the sequencer 9 may be used as a control unit performing a feedback control for the stirring air-feeding unit 6 and with respect to the air feeding passage 61. In detail, the sensor 67 will detect the internal pressure appearing in this passage and downstream of the regulator 66. The sequencer 9 will function also in this case to feedback control the downstream pressure on the basis of data signals from said sensor 67. In order to enable such a feed-back control, the sequencer 9 may serve as a determination unit that determines the timing at which said control valve 65 should be closed based on the sum of data signals that would have been transmitted from sensor 67 after opening the valve 65.

The stirring-air feeding unit 6 serves to supply a compressed air at the target pressure to the stirring chamber 44 in spray gun 4, through the air feed passage 61. The powder particles from the other passage 51 will thus be agitated in the air stream so as to be dispersed more finely, while being prevented from cohering together.

The air feed passage 61 is formed as a flow line that starts from the air tank 62 and leads to the spray gun 4, through the control valve 65 and regulator 66. The air stream delivered through this passage will stir the powder effluent from the powder feeding passage 51. The powder stirred within the stirring chamber 44 is sent together with said air stream towards the spray gun 4 so as to be ejected from its jet nozzle 41 into the tube 2.

The powder collecting unit 7 for the skirt of each tube is composed of the powder collecting passage 71 for sucking and eliminating a surplus of powder from the skirt opening 21*a* of the tube barrel 21, a compressed air tank 72, a T-shaped ejector pump 74, an electromagnetic switching (interrupting) valve 75, a regulator 76 and an air pressure sensor 77. The interior of air tank 72 is controlled to be at a given level of internal pressure, and the ejector pump 74 is composed of an upstream portion 74*a*, a down-stream portion 74*b* and a branch 74*c*. Both the electromagnetic valve 75 and regulator 76 are disposed in a first section 71*a* of the passage 71 and between the tank 72 and ejector pump 74. The sensor 77 is located downstream of the regulator 76, although it may be disposed upstream of this regulator. The sensor may alternatively be arranged in a second section 71*b* of the passage 71 so as to be located downstream of the ejector pump 74, or at an intermediate region of a suction section 71*c* formed as a third part of the passage 71.

The first section 71*a* of passage 71 connects the air tank 72 to the ejector pump upstream portion 74*a* for receiving a stream of compressed ejection air. The second section 71*c* for sucking the aerosol of powder to collect a surplus thereof does connect the ejector pump's branch 74*c* to the sideways outlet 42*b* of spray gun body 42. The second section 71*b* connects the ejector pump downstream portion 74*b* to a suction tank not shown, and the second section 71*c* may be a length of a flexible piping material.

The ejector pump 74, air tank 72, control valve 75, regulator 76 and sensor 77 are respectively of structures similar to those included in the powder feeding unit 5.

Similarly to the case of powder conveying unit 5, the sequencer 9 may be used as a control unit performing a feedback control for the powder collecting unit 7 in relation to the powder collecting passage 71. In detail, the sensor 77 will detect the internal pressure appearing in this passage and downstream of the regulator 76. The sequencer 9 will function also in this case to feedback control the downstream pressure on the basis of data signals from said sensor 77. In order to enable such a feed-back control, the sequencer 9 may serve as a determination unit that determines the timing at which said control valve 75 should be closed based on the sum of data signals that would have been transmitted from sensor 77 after opening the valve 75.

The second section 71*c* connects the collecting unit 7 to the powder collecting cylinder 43 of spray gun 4 so that a surplus of powder is sucked from the proximity of the tube's 2 skirt into the suction tank not shown.

The further powder collecting unit 8 for the mouth of each tube is composed of the powder collecting passage 71 for sucking and eliminating a surplus of powder from the mouth 23 of tube, a compressed air tank 82, a T-shaped ejector pump 84, an electromagnetic switching (interrupting) valve 85, a regulator 86 and an air pressure sensor 87. The interior of air tank 82 is controlled to be at a given level of internal pressure, and the ejector pump 84 is composed of an upstream portion 84a, a downstream portion 84*b* and a branch 84*c*. Both the electromagnetic valve 85 and regulator 86 are disposed in a first section 81*a* of the passage 81 and between the tank 82 and ejector pump 84, with the sensor 87 being located downstream of the regulator 86.

The first section 81*a* of passage 81 connects the air tank 82 to the ejector pump upstream portion 84*a* for receiving a stream of compressed ejection air. The second section 81*c* for sucking the aerosol of powder to collect a surplus thereof does connect the ejector pump's branch 84*c* to the opening 3*a* of the holder 3 surrounding the tube mouth. The second section 81*b* connects the ejector pump downstream portion 84*b* to a suction tank not shown, and the second section 81*c* may be a length of a flexible piping material.

The ejector pump 84, air tank 82, control valve 85, regulator 86 and sensor 87 are respectively of structures similar to those included in the powder feeding unit 5.

Similarly to the case of powder conveying unit 5, the sequencer 9 may be used as a control unit performing a feedback control for the further powder collecting unit 8 in relation to the powder collecting passage 81. In detail, the sensor 87 will detect the internal pressure appearing in this passage and downstream of the regulator 86. The sequencer 9 will function also in this case to feedback control the downstream pressure on the basis of data signals from said sensor 87. In order to enable such a feed-back control, the sequencer 9 may serve as a determination unit that determines the timing at which said control valve 85 should be closed based on the sum of data signals that would have been transmitted from sensor 87 after opening the valve 85.

The second section 81*c* connects the further collecting unit 8 to the holder portion adjacent to the tube south so that a surplus of powder is sucked from the proximity of the tube's 2 mouth into the suction tank not shown.

In operation, the tube 2 will be placed at first in the holder 3 of the powder coating apparatus 1 provided in this embodiment, before the jet nozzle 41 of spray gun 4 is inserted into the tube through its skirt opening 21*a* by a proper short distance. Subsequently, powder particles are ejected out of the end opening 41*a* of nozzle while being charged with electrostatic charges and ejected from the end opening of nozzle 41. Thus, those powder particles will electrostatically adhere to the inner peripheries of barrel 21, shoulder 22 and mouth 23.

On the other hand and at the same time, a surplus of powder particles not having stuck to said peripheries of tube 2 but floating in the proximity of mouth 23 thereof will be sucked and collected through the further suction passage 81. Another surplus of powder particles not having stuck to said peripheries of tube 2 but floating between the skirt 21*a* of tube and the suction cylinder 43 will also be sucked and collected through the other suction passage 71. It is to be noted here as a characteristic feature that the nozzle 41 is inserted into the skirt 21*a* a proper distance so that an excessive amount of powder particles are sucked back out of the proximity of the end opening of nozzle 41, through the suction cylinder 43, in order to prevent the powder particles from adhering to the inner peripheral zone defining the skirt 21*a*.

Results of Performance Tests

The present inventors have conducted performance tests on the apparatus and rated the results thereof, wherein the feedback control by unit of the sequencer 9 was not applied to the apparatus in one case, but was done so in the other cases. In these tests, pressure fluctuation in each flow passage as well as coating quality on the tube inner periphery were recorded and checked.

Figure 3:
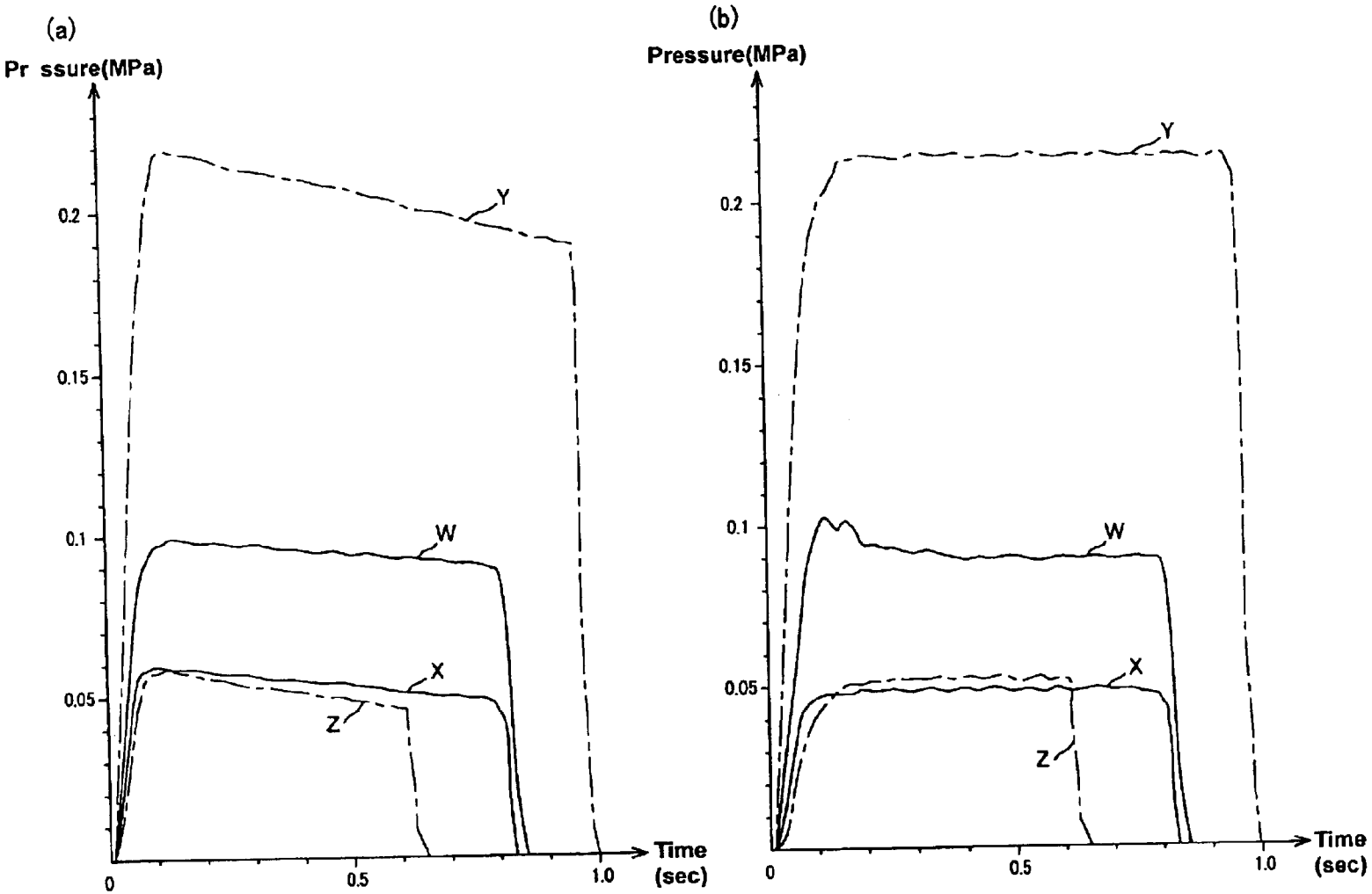
FIG. 3 is two graphs showing fluctuation or change in the internal pressure in each of flow passages included in different modes of operating the apparatus in which no feedback control is applied.

Graph (a) in FIG. 3 is a graph showing the performance of a rough and un-perfect model of coating apparatus, with this model having been tried in the course of developing the present well-sophisticated apparatus and therefore having not comprised any feedback control system for the flow rate or internal pressure. This model showed pressure fluctuation in each flow passage, as seen in the graph (a) wherein the reference symbol 'W' denotes a curve of signals output from the sensor 57 in the powder feeding unit 5. The further reference symbol 'X' denotes another curve of further signals output from the sensor 67 in the stirring air-feeding unit 6. The still further reference symbols 'Y' and 'Z' respectively denote two further curves of still further signals output from the sensor 77 in the powder collecting unit 7 for the tube skirts, or output from the sensor 87 in the further collecting unit 8 for the tube mouths.

As the graph (a) indicates, the internal pressure of each passage did rise acutely to a peak when the relevant electromagnetic control valve was opened. The peak could however not be maintained, due to a subsequent fall in the pressure of air fed from the air tank. This graph represents the change in air pressure during only one cycle of ejecting the powder, and it was observed that the pattern itself of such a change had not been constant but extremely varied among many repeated cycles.

The inventors did accordingly conduct further coating tests at several levels of the internal pressure of each passage, but failing to produce uniform coating on the tube inner peripheries and to reliably mask the tube skirts. In addition, any noticeable reproducibility was neither afforded as to the thickness of such coated membranes, nor as to the masked state of those tube skirts.

In view of these preliminary test results, the inventors did subsequently attempt to optimize the piping of each flow passages in such a rough and unperfect test apparatus. The passages to be improved were the powder feeding passage 51, the stirring air-feeding passage 61, and the powder collecting passages 71 and 81 for the tube skirts and tube mouths, respectively. In detail, lugs or stepwise irregularities at a joint between the sections of said piping were eliminated so as to avoid any sharp or sudden change in the passage's diameter. If the inner diameter had to be altered at any point, then the piping section was gradually increased or decreased in diameter. At any further point of passage where it had to be curved, its radius of curvature was maximized. Additionally, air feed pressure to each passage was stabilized by incorporation of an auxiliary tank between the on-off control valve and the air tank for the passage.

In such an improved type of the apparatus, a pressure sensor was disposed downstream of the control valve so as to monitor the change in internal pressure in each flow passage. The data thus obtained in such an improved apparatus are shown at Graph (b) in FIG. 3, also in the form of a graph. As will be seen there, inclination of the curve portion corresponding to the start of air feed when the control valve had been opened did become gentler and gentler towards the peak. The supplementary and auxiliary air tank contributed to stabilization of air feed pressure, thereby rendering it almost constant during every cycle of jetting the powder.

Table 1 gives the results of a series of coating tests carried out on the apparatus improved in the manner just described above. In these tests, the pressure to be detected by the sensor for each flow passage was selected to fall either within a first range of 0.11 to 0.20 MPa (viz., condition 'A') or within a second range of 0.21 to 0.30 MPa (viz., condition 'B'). Sixteen (16) tests numbered '1'–'16' were done as seen in Table 1, wherein hundred (100) tubes were subjected to the coating process to provide hundred coated samples in each test No. 1 to No. 16.

TABLE 1

| | Test No. | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| Pressure | | | | | | | | | | | | | | | | |
| Powder Feed | A | B | A | B | A | B | A | B | B | A | A | B | B | A | A | B |

TABLE 1-continued

| | Test No. | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| Stirring Air | A | B | A | B | A | B | B | A | A | B | A | A | B | B | B | A |
| Collect from skirt | A | B | A | B | B | A | A | B | A | B | B | B | A | B | A | A |
| Collect from mouth | A | B | B | A | A | B | A | B | A | B | B | A | A | A | B | B |
| Quarity of coating | | | | | | | | | | | | | | | | |
| Mouth | X | X | X | X | ○ | X | X | ○ | X | X | X | ○ | ○ | ○ | X | X |
| Shoulder | X | X | X | ○ | ○ | ○ | X | ○ | ○ | ○ | ○ | ○ | ○ | ○ | ○ | ○ |
| Barrel | ○ | X | ○ | X | ○ | X | X | ○ | X | X | ○ | ○ | ○ | ○ | ○ | ○ |
| Masking Part | X | X | X | X | ○ | X | X | ○ | X | X | ○ | X | X | X | X | X |
| Overall Evaluation | X | X | X | X | ○ | X | X | ○ | X | X | X | X | X | X | X | X |

Pressure
A: 0.11~0.20 (MPa)
B: 0.21~0.30 (MPa)

<Details of the Coating Qualities>

(1) Amount of the powder stuck to tube inner peripheries:

Variation in amount of the powder stuck to the tubes' inner peripheries decreased under the same condition of pressures, thereby indicating an improved reproducibility. Each cycle of jetting the powder gave the coated amount of powder falling within a range of from 0.4–0.6 grams.

(2) Quality of the coated mouths:

The resin coatings showed each a more uniform thickness.

(3) Quality of the coated shoulders:

Because the pressures for ejecting and collecting the resin powder particles had not only been stabilized but also optimized to reduce the powder adhesion, the average thickness of resin coating was observed to be 500–1000 $\mu$m.

(4) Quality of the coated barrels:

Ratio of the defective coatings (having pinholes) on the barrels was observed to be lower than 0.3%, with the average thickness of resin coating being 50–150 $\mu$m.

(5) Successive cycles of the coating process:

It was possible to do more than seven hundred (700) cycles of the coating process in a successive manner, without causing any of the passages and spray gun to be clogged with the resin powder.

In this series of tests, the tubes in some of the sixteen tests showed to have uniform resin coatings on their mouths, shoulders and barrels and also showed well masked skirts, depending on the pressure condition in each flow passage.

Next, the coating apparatus 1 of the described preferable embodiment was operated while monitoring the data signals from the pressure sensors to measure the internal pressure at the step of ejecting the powder. A graph (c) in FIG. 4 indicates fluctuation in the pressures thus measured.

Figure 4:
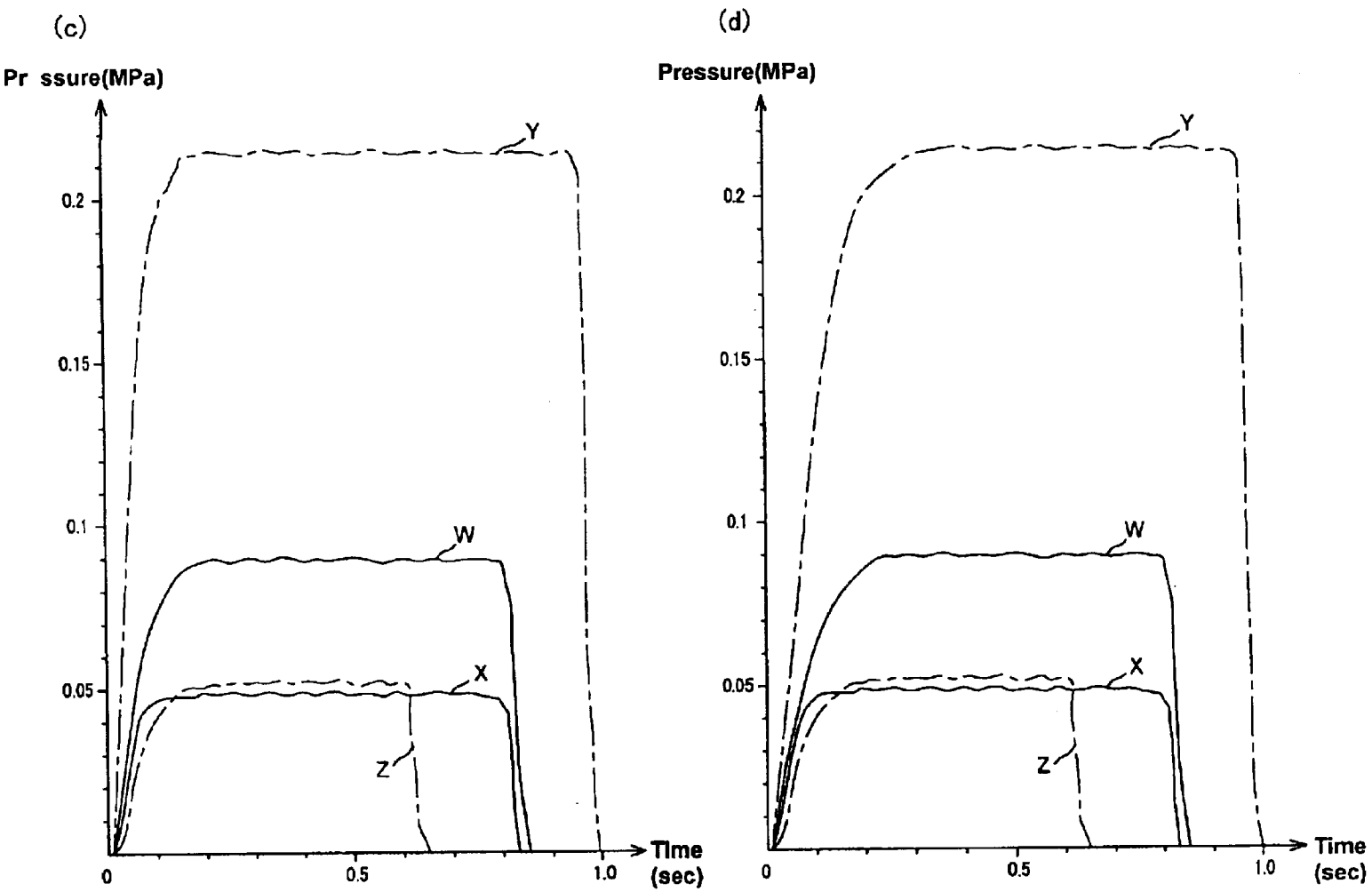
FIG. 4 is two graphs showing fluctuation or change in the internal pressure in each of flow passages that are included in the apparatus, wherein feedback control is applied to each passage during the step of blowing the powder into said tube.

As will be seen from this graph (c) in FIG. 4, any peak did not appear in the rising phase of the said pressure 'W' in the resin powder feeding unit 5. Fluctuation in pressure was also suppressed to give a further stable curve as compared with the graph shown at Graph (b). As a result of repetitive tests, it proved satisfactory in reproducibility of performance.

Table 2 lists the results obtained by testing the apparatus 1 of this mode, wherein the test conditions and the standards of rating and evaluation were the same as those referred to above in connection with Table 1.

<Details of the Coating Qualities>

(1) Amount of the powder stuck to tube inner peripheries:

Variation in amount of the powder stuck to the tubes' inner peripheries decreased under the same condition of pressures, thereby indicating a further improved reproducibility. Each cycle of jetting the powder gave the coated amount of powder falling within a range of from 0.2–0.4 grams.

(2) Quality of the coated mouths:

The resin coatings showed each a much more uniform thickness, by virtue of the stabilized amount of the resin powder stuck.

(3) Quality of the coated shoulders:

Because the pressures for ejecting and collecting the resin powder particles had not only been stabilized but also further optimized to reduce the powder adhesion, the average thickness of resin coating was further lowered to less than 500 $\mu$m.

(4) Quality of the coated barrels:

Ratio of the defective coatings (having pinholes) on the barrels was observed to be 0.2% or less, with the average thickness of resin coating being 50–150 $\mu$m.

(5) Successive cycles of the coating process:

It was possible to do more than five thousand (5000) cycles of the coating process in a successive manner, without causing any of the passages and spray gun to be clogged with the resin powder.

In these performance tests, the tubes in much more of the sixteen species showed uniform resin coatings on their mouths 23, shoulders 22 and barrels 21 and also showed well masked skirts 21*a*, depending on combination of the pressures in flow passages. Reproducibility of such excellent performances of the apparatus did also prove satisfactory.

By adjusting the diameter of each piping sections forming the flow passages in the powder coating apparatus 1, and also adjusting the pressure of the compressed air tanks, the inclination of each curve was made much gentler in the rising phase thereof as shown at Graph (d) in FIG. 4. Such a founding was obtained in the course of the performance tests as discussed hereinabove to optimize the piping and stabilize the air feed pressure. Any tubes can now be powder coated in an optimum manner by selecting the most adequate pressure conditions.

TABLE 2

| | Test No. | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| Pressure | | | | | | | | | | | | | | | | |
| Powder Feed | A | B | A | B | A | B | A | B | B | A | A | B | B | A | A | B |
| Stirring air | A | B | A | B | A | B | B | A | A | B | A | A | B | B | B | A |
| Collect from skirt | A | B | A | B | B | A | A | B | A | B | B | B | A | B | A | A |
| Collect from mouth | A | B | B | A | A | B | A | B | A | B | B | A | A | A | B | B |
| Quarity of coating | | | | | | | | | | | | | | | | |
| Mouth | ○ | ○ | X | ○ | ○ | X | X | ○ | ○ | ○ | ○ | ○ | X | X | ○ | ○ |
| Shoulder | ○ | ○ | ○ | ○ | ○ | ○ | ○ | ○ | ○ | ○ | ○ | ○ | ○ | ○ | ○ | ○ |
| Barrel | ○ | ○ | ○ | ○ | ○ | ○ | ○ | ○ | ○ | ○ | ○ | ○ | ○ | ○ | ○ | ○ |
| Masking Part | ○ | X | ○ | ○ | ○ | X | X | ○ | ○ | ○ | ○ | ○ | X | ○ | X | ○ |
| Overall Evaluation | ○ | X | X | ○ | ○ | X | X | ○ | ○ | ○ | ○ | ○ | X | X | X | ○ |

Pressure
A: 0.11~0.20 (MPa)
B: 0.21~0.30 (MPa)

Summarizing the present invention, it provides a powder coating apparatus characterized in that the pressure and/or flow rate of the gas stream flowing through each passage are stabilized so that the powder can be ejected towards the inner periphery of every tube in a well stabilized manner. Surplus of the powder thus ejected into the tube can also be collected in a reliable manner. A smooth membrane is now formed on said periphery, protecting the spray gun and the passages from being jammed with the powder and at the same time raising efficiency of production of such coated tubes.

What is claimed is:

1. A method of electrostatically forming a coating on an inner periphery of a tube that has a cylindrical barrel, a mouth provided on one axial end of the barrel, and a shoulder located between the barrel and the mouth, the method comprising the steps of:

preliminarily holding the tube in a holder, and subsequently jetting powder into the container from a spray gun, through an opening disposed on the other axial end of said barrel of the tube held in the holder, wherein a first passage is used to guide to the spray gun a first air stream together with the powder to be jetted, a second passage is used to feed to the spray gun a second air stream that is being supplied with the powder, a third passage is used to suction collect surplus powder through the mouth of the tube, and a fourth passage is used to suction collect surplus powder through the opening of the tube on the other axial end of the barrel of the tube, and wherein at least one of the first to fourth passages is subject to such a feedback control that flow rate and/or internal pressure of the at least one passage are maintained at target levels, the feedback control controlling a regulator based on signals from a sensor such that flow rate and/or internal pressure of the at least one passage are maintained at target levels, the regulator disposed at an intermediate point of the at least one passage and being actuated to regulate the internal pressure in and/or flow rate through the at least one passage, the sensor disposed at an intermediate point of the at least one passage on a downstream side of the regulator and detecting the internal pressure and/or flow rate of the at least one passage.

2. The method as defined in claim 1, wherein the feedback control is carried out for each of the first to fourth passages.

3. The method as defined in claim 1, wherein ratio of an average thickness of the coating formed on an inner periphery of the shoulder to that of the coating on an inner periphery of the barrel is made less than 10.

* * * * *